US012352474B2

(12) United States Patent
Schmidt et al.

(10) Patent No.: US 12,352,474 B2
(45) Date of Patent: Jul. 8, 2025

(54) HEAT EXCHANGER

(71) Applicant: Dantherm Cooling, Inc., Spartanburg, SC (US)

(72) Inventors: Charles Richard Schmidt, Spartanburg, SC (US); Troy F. Berg, Spartanburg, SC (US)

(73) Assignee: Dantherm Cooling, Inc., Spartanburg, SC (US)

( * ) Notice: Subject to any disclaimer, the term of this patent is extended or adjusted under 35 U.S.C. 154(b) by 377 days.

(21) Appl. No.: 18/084,775

(22) Filed: Dec. 20, 2022

(65) Prior Publication Data

US 2023/0194133 A1 Jun. 22, 2023

Related U.S. Application Data

(60) Provisional application No. 63/291,509, filed on Dec. 20, 2021.

(51) Int. Cl.
*F25B 39/02* (2006.01)
*F25D 17/06* (2006.01)

(52) U.S. Cl.
CPC ..... *F25B 39/02* (2013.01); *F25D 17/067* (2013.01)

(58) Field of Classification Search
CPC ..... F25B 39/02; F25B 39/04; F25D 17/067; F28D 1/0226; F04F 10/00; F04F 10/02; F24S 20/30; F24S 20/40; F24S 20/61; F24S 80/00; F24S 80/30; F24D 3/005
See application file for complete search history.

(56) References Cited

U.S. PATENT DOCUMENTS 6,382,308 B2 * 5/2002 Okamoto ..... F25B 23/006 165/104.21
2013/0292100 A1 * 11/2013 Karlsson ..... E04C 1/392 165/163

FOREIGN PATENT DOCUMENTS

EP 3830866 B1 * 12/2024 ..... F28D 3/02
WO WO-2010040635 A1 * 4/2010 ..... F28B 1/06

* cited by examiner

*Primary Examiner* — Miguel A Diaz
(74) *Attorney, Agent, or Firm* — CASIMIR JONES, S.C.; Brian F. Bradley

(57) ABSTRACT

A heat exchanger assembly including a housing with an external air inlet, an external air outlet, an internal air inlet, and an internal air outlet. The heat exchanger assembly further includes a heat exchanger with an angled condenser panel, an angled evaporator panel, and a working fluid. The heat exchanger assembly further includes a first fan positioned at the internal air inlet configured to create an internal airflow through the housing from the internal air inlet to the internal air outlet, and a second fan positioned at the external air inlet configured to create an external airflow through the housing from the external air inlet to the external air outlet. The external airflow is isolated from the internal airflow.

15 Claims, 4 Drawing Sheets

HEAT EXCHANGER

RELATED APPLICATIONS

This application claims priority to and the benefit of U.S. Provisional Patent Application No. 63/291,509 filed Dec. 20, 2021, which is incorporated herein by reference in its entirety for all purposes.

FIELD

The present disclosure provides systems, materials, devices, and methods related to passive cooling systems. In particular, the present disclosure provides a passive heat exchanger system with enhanced cooling capacity for environments ranging from outdoor electronic enclosures to commercial and residential buildings.

BACKGROUND

To address and alleviate the challenges and inefficiencies that arise because of heat generated naturally from the sun or from using electronic and industrial equipment, two main categories of cooling systems are generally recognized: active and passive cooling systems. The advantages of passive cooling technologies include energy efficiency and lower financial cost, making these systems particularly useful for the thermal management of both buildings and electronic products. Passive cooling achieves high levels of natural convection and heat dissipation by utilizing a heat sink to maximize the radiation and convection heat transfer modes. Such heat transfer modes cool electronic products and environments to keep them under the maximum allowed operating temperature.

Active cooling, on the other hand, refers to cooling technologies that rely on an external device to enhance heat transfer. Through active cooling technologies, the rate of fluid flow increases during convection, which dramatically increases the rate of heat removal. Active cooling solutions include forced air through a fan or blower, forced liquid, and thermoelectric coolers (TECs), which can be used to optimize thermal management on all levels. Fans are used when natural convection is insufficient to remove heat. They are commonly integrated into electronics, such as computer cases, or are attached to CPUs, hard drives or chipsets to maintain thermal conditions and reduce failure risk. The main disadvantage of active thermal management is that it requires the use of electricity (e.g., a passive solution can use some electricity, such as fans, whereas active thermal management generally uses a pump or compressor in addition to the fans) and therefore results in higher costs, compared to passive cooling.

For electronic enclosures, which generally include systems designed to house and protect sensitive and valuable computer and electronic equipment (e.g., equipment used by the Telecom, Industrial, Natural Resources Refining, Federal and Municipal Government or other industries), it is necessary for the internal area of the enclosure to be climate controlled (e.g., regulated temperature and humidity) and to be protected from the intrusion of dust and debris from the outside environment. Often times, to control the environment of the electronic enclosure, a climate control unit (CCU) is used. A CCU is designed to reduce intrusion of outdoor contaminates like dust, water, salt etc. while also controlling the temperature of the equipment being protected. Examples of active cooling CCUs include air conditioners, heat pumps, and water source geothermal HVAC systems. Examples of passive cooling CCUs include air to air heat exchangers, heat pipes, and thermosiphons. Passive cooling typically offers lower electrical consumption, with less heat removal capacity in comparison to an active cooling unit.

With increasing heat load requirements in electronic enclosures, as well as commercial and residential buildings, currently available passive cooling technology has not been widely implemented despite its advantages. Although active cooling technologies provide increased capacities, higher costs coupled with increased energy consumption creates operational burdens. Thus, there is a demand for a CCU that operates with low energy consumption while still offering higher heat removal that will effectively bridge the gap between passive and active cooling technologies.

SUMMARY

The Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure provides a heat exchanger including a first coil panel having a first lower header and a first upper header and a second coil panel having a second lower header and a second upper header. The heat exchanger further includes a first tube and a second tube extending between the first upper header and the second upper header, and a third tube and a fourth tube extending between the first lower header and the second lower header. A working fluid is positioned within the first coil panel, the second coil panel, the first tube, the second tube, the third tube, and the fourth tube.

In some embodiments, the first coil panel is positioned below the second coil panel.

In some embodiments, the first upper header is positioned between the first lower header and the second lower header.

In some embodiments, the first coil panel is angled with respect to a vertical plane.

In some embodiments, the first coil panel forms an angle with respect to the vertical plane within a range of 0 degrees to 80 degrees. In some embodiments, the angle is 20 degrees.

In some embodiments, the second coil panel is angled with respect to the vertical plane.

In some embodiments, the second coil panel forms an angle with respect to the vertical plane within a range of 0 degrees to 80 degrees. In some embodiments, the angle is 20 degrees.

In some embodiments, the heat exchanger further includes a fifth tube extending between the first upper header and the second upper header, and a sixth tube extending between the first lower header and the second lower header; wherein the working fluid is positioned within the fifth tube and the sixth tube.

In some embodiments, a flowrate of the working fluid between the first coil panel and the second coil panel is within a range of 0.3 $in^3/s$ to 1.0 $in^3/s$.

In some embodiments, the first tube includes a diameter within a range of 12 mm to 22 mm.

In some embodiments, the first coil panel includes a plurality of channels, and wherein each of the plurality of channels includes a plurality of microchannels, and wherein each of the plurality of microchannels comprise a plurality of fins extending from the plurality of microchannels that increase the surface area for heat transfer.

In some embodiments, the first lower header and first upper header are sealed to create sealed compartments, wherein the working fluid can move freely within both the sealed compartments, wherein the first upper header comprises working fluid in a substantially gaseous state, and wherein the first lower header comprises working fluid in a substantially liquid state.

In some embodiments, the heat exchanger further includes a dividing wall positioned between the first coil panel and the second coil panel.

In some embodiments, the first tube, the second tube, the third tube, and the fourth tube extend through the dividing wall.

One aspect of the present disclosure provides a heat exchanger assembly including a housing with an external air inlet, an external air outlet, an internal air inlet, and an internal air outlet. The heat exchanger assembly further includes a heat exchanger including an angled condenser panel, an angled evaporator panel, and a working fluid. The heat exchanger assembly further includes a first fan positioned at the internal air inlet configured to create an internal airflow through the housing from the internal air inlet to the internal air outlet, and a second fan positioned at the external air inlet configured to create an external airflow through the housing from the external air inlet to the external air outlet. The external airflow is isolated from the internal airflow.

In some embodiments, the angled condenser panel is positioned above the angled evaporator panel.

In some embodiments, the heat exchanger further includes a first plurality of tubes extending between an upper evaporator header and an upper condenser header, and a second plurality of tubes extending between a lower evaporator header and a lower condenser header.

In some embodiments, the external airflow is isolated from the internal airflow by a dividing wall positioned within the housing.

BRIEF DESCRIPTION OF THE DRAWINGS

The accompanying figures and examples are provided by way of illustration and not by way of limitation. The foregoing aspects and other features of the disclosure are explained in the following description, taken in connection with the accompanying example figures ("FIG.") relating to one or more embodiments.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

"About" and "approximately" are used to provide flexibility to a numerical range endpoint by providing that a given value may be "slightly above" or "slightly below" the endpoint without affecting the desired result.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "top" and "bottom", "front" and "rear", "inner" and "outer", "above", "below", "upper", "lower", "vertical", "horizontal", "upright" and the like are used as words of convenience to provide reference points.

Unless otherwise defined herein, scientific and technical terms used in connection with the present disclosure shall have the meanings that are commonly understood by those of ordinary skill in the art. The meaning and scope of the terms should be clear; in the event, however of any latent ambiguity, definitions provided herein take precedent over any dictionary or extrinsic definition. Further, unless otherwise required by context, singular terms shall include pluralities and plural terms shall include the singular.

Figure 1:
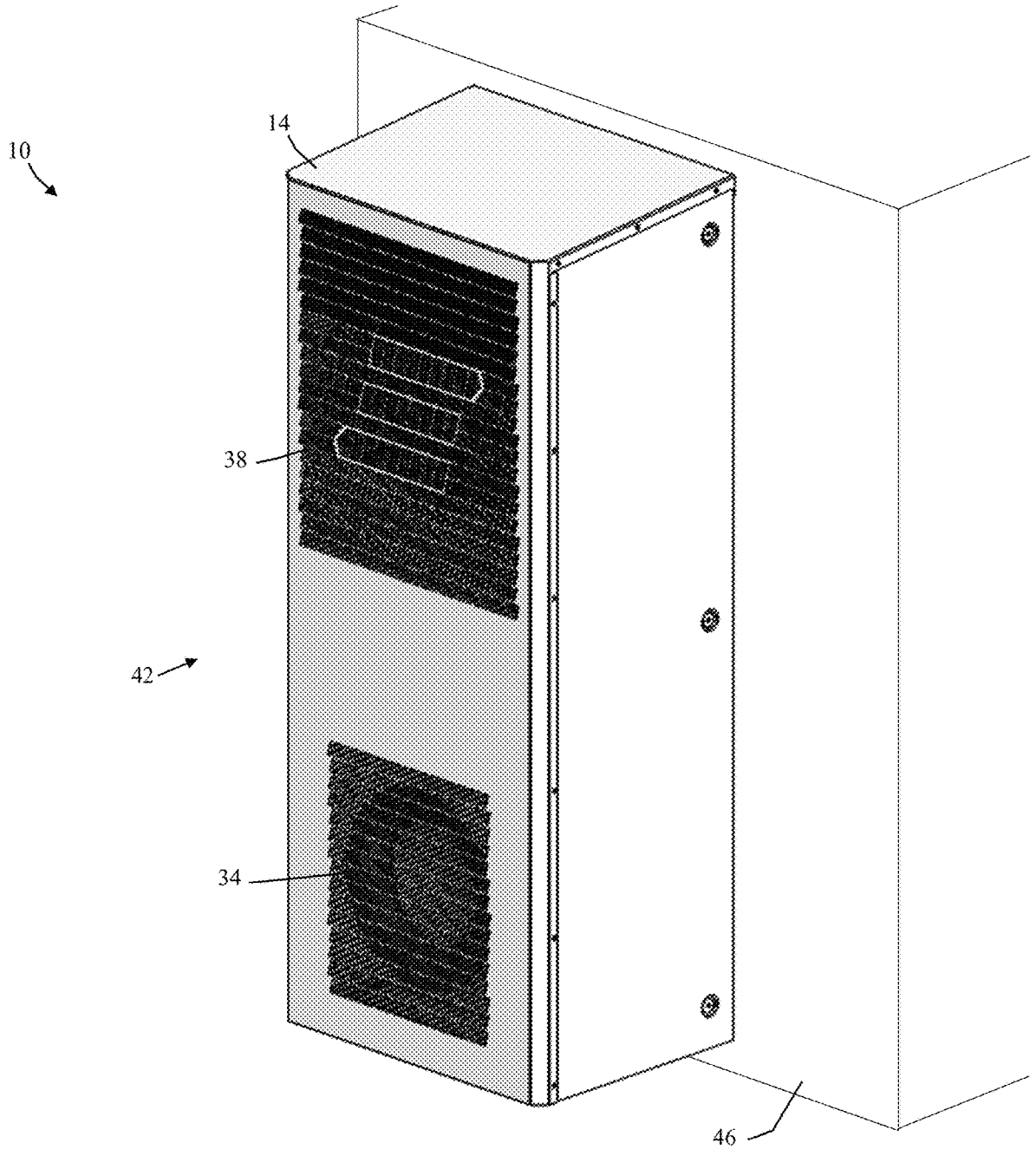
FIG. 1 is a perspective view of a heat exchanger assembly.
Figure 2:
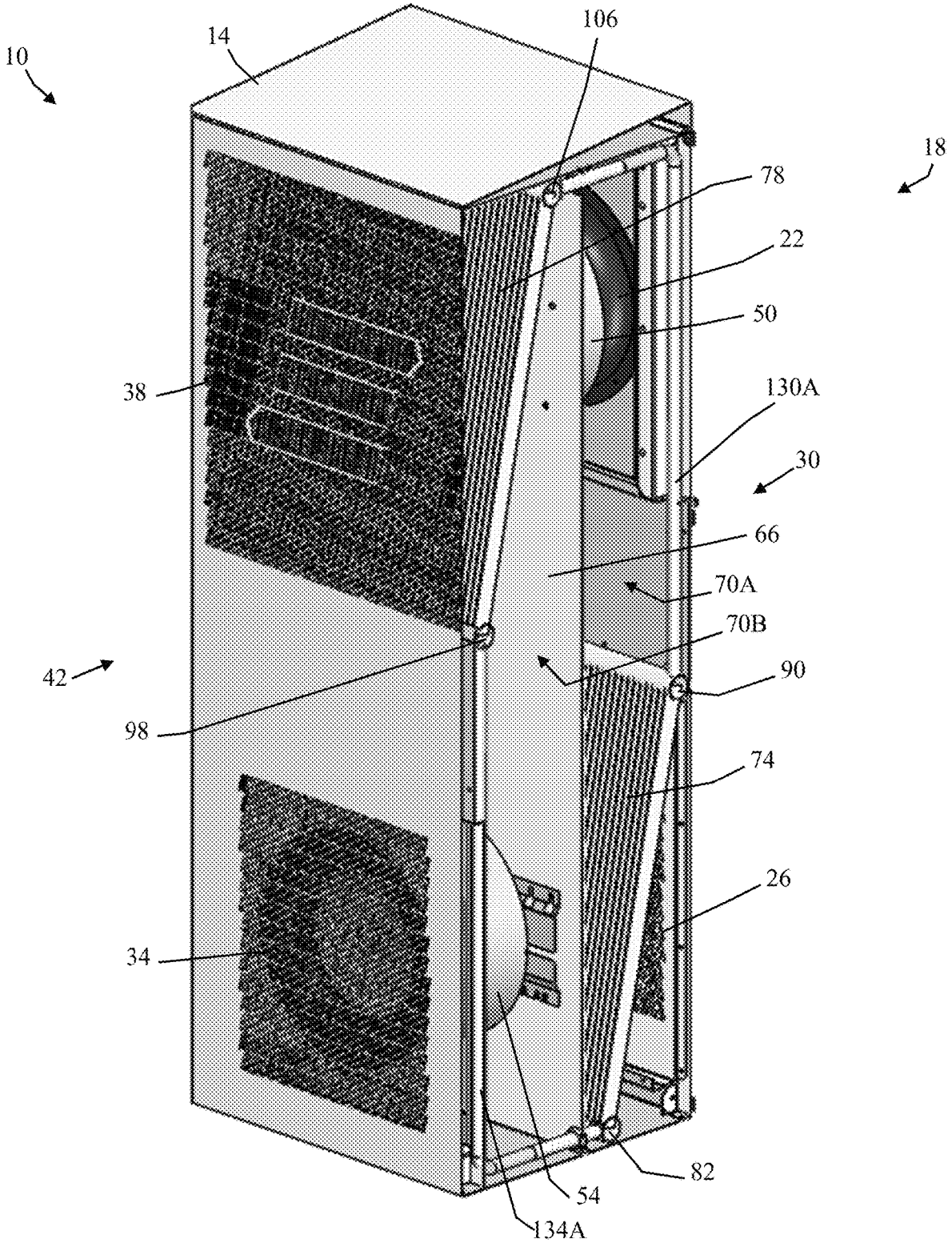
FIG. 2 is a perspective view of the heat exchanger assembly of FIG. 1, with portions of a housing removed.
Figure 3:
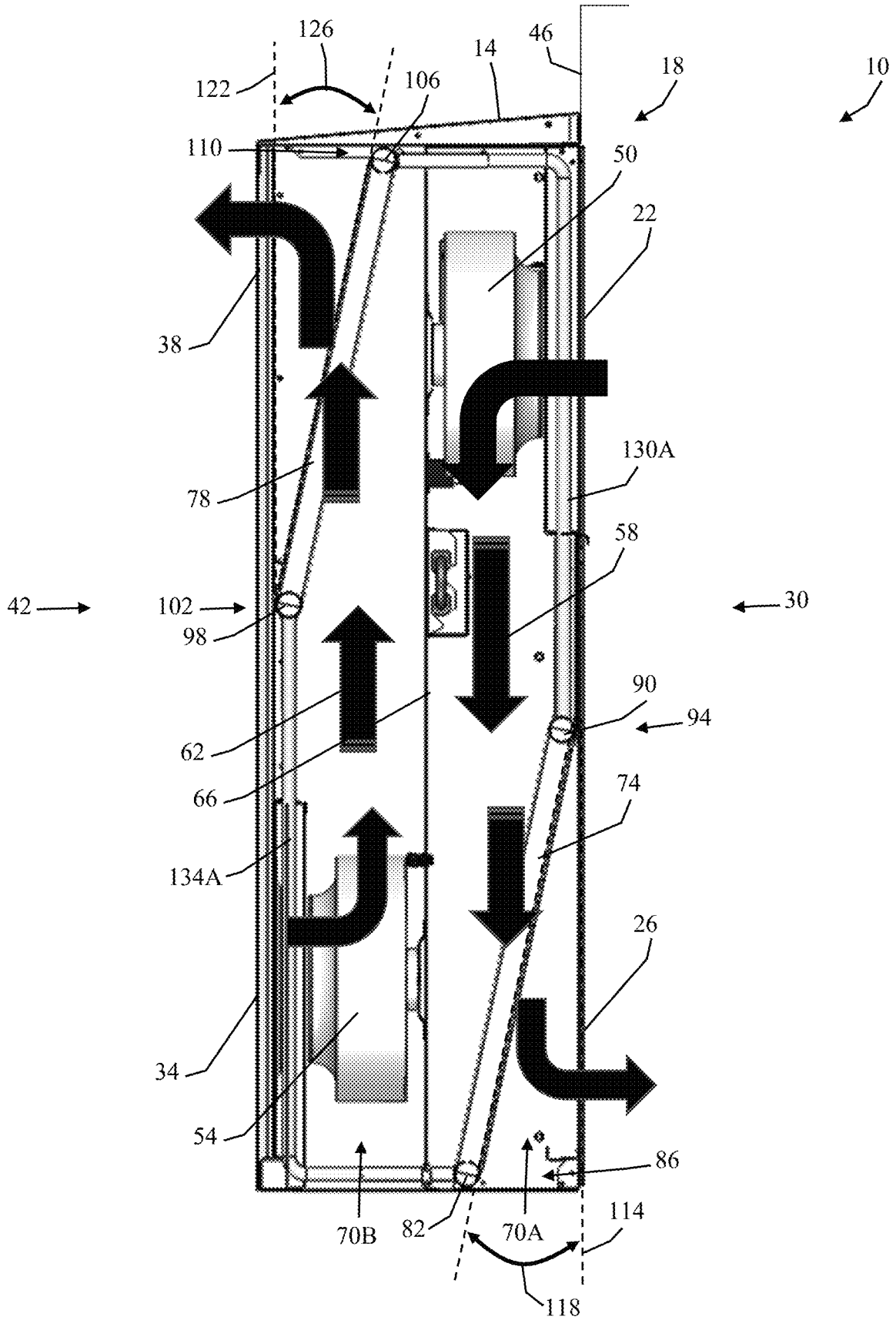
FIG. 3 is a cross-sectional view of the heat exchanger assembly of FIG. 1, with arrows illustrating an external airflow and an internal airflow.

With reference to FIGS. 1 and 2, a heat exchanger assembly 10 includes a housing 14 and a heat exchanger 18 (i.e., a passive heat exchanger). The housing 14 includes an internal air inlet 22 and an internal air outlet 26 on a first side 30, and an external air inlet 34 and an external air outlet 38 on a second side 42, opposite the first side 30 (FIG. 3). In the illustrated embodiment, the internal air inlet 22 and the internal air outlet 26 are covered with a grate and/or mesh material. The heat exchanger assembly 10 is generally mounted to an enclosure-of-interest 46, such as but not limited to, an enclosure (e.g., cabinet) that houses electrical or computer equipment, or a commercial or residential building.

As described herein, embodiments of the heat exchanger assembly 10 and systems of the present disclosure can be mounted to the enclosure-of-interest 46 to reduce heat load generated within the enclosure-of-interest 46 (e.g., heat load generated by computer or electrical equipment). In accordance with these embodiments, the devices and systems of the present disclosure can provide enhanced or improved cooling capacity and/or performance for a given enclosure without contaminating internal and external airflow paths.

With continued reference to FIG. 2, the heat exchanger assembly 10 further includes a first fan 50 and a second fan 54. The first fan 50 is positioned at the internal air inlet 22 and is configured to create an internal airflow 58 through the housing 14 from the internal air inlet 22 to the internal air outlet 26. The second fan 54 is positioned at the external air inlet 34 and is configured to create an external airflow 62 through the housing 14 from the external air inlet 34 to the external air outlet 38. In the illustrated embodiment, the first fan 50 is positioned vertically above the second fan 54. In some embodiments, the fans 50 & 54 are controlled to operate at a variable speed. In other embodiments, the fans operate at a constant speed.

With reference to FIG. 3, the internal airflow 58 is isolated from the external airflow 62. In the illustrated embodiment, the internal airflow 58 is isolated and separated from the external airflow 62 by a dividing wall 66 (a.k.a. divider plate) positioned within the housing 14. In other words, the dividing wall 66 facilitates the separation of an external airflow path from an internal airflow path to prevent contamination of the internal environment of the enclosure-of-interest 46 with dust, debris, dirt, salt, precipitation, and the like, from the environment outside of the enclosure-of-interest 46. In some embodiments, the dividing wall 66 creates a substantially air-tight seal that divides the housing 14 into a first chamber 70A and a second chamber 70B. In the illustrated embodiment, the dividing wall 66 is oriented approximately vertically in the housing 14. In other embodiments, the dividing wall is angled with respect to a vertical axis. In some embodiments, the dividing wall 66 is welded, brazed, or fitted mechanically with a sealant compound into position during assembly of the heat exchanger assembly 10 such that it is generally in a fixed position. Welding can include, for example, TIG welding or laser welding, though other suitable types of welding could also be used.

Figure 4:
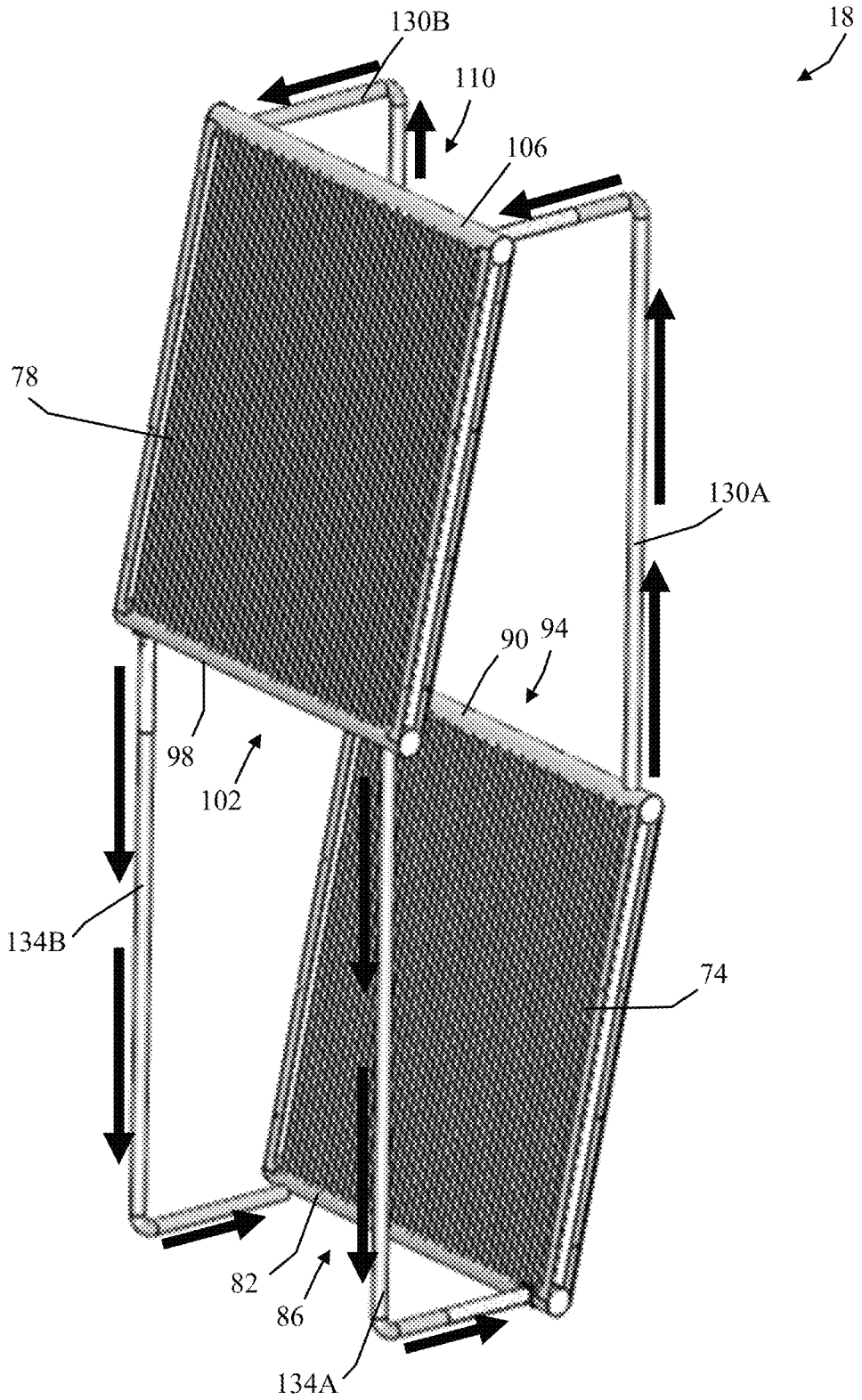
FIG. 4 is a perspective view of a heat exchanger of the heat exchanger assembly of FIG. 1, with arrows illustrating a flow of a working fluid.

With reference to FIG. 4, the heat exchanger 18 includes a first coil panel 74 and a second coil panel 78. In the illustrated embodiment, the dividing wall 66 is positioned between the first coil panel 74 and the second coil panel 78. The first coil panel 74 is separated from the second coil panel 78 in the illustrated embodiment. In other words, the first coil panel 74 is in the first chamber 70A and the second coil panel 78 is in the second chamber 70B. In some embodiments, the coil panels 74, 78 are microchannel coil panels. In other embodiments, the coil panels 74, 78 are fin and tube type panels. In the illustrated embodiment, the first coil panel 74 is an evaporator and the second coil panel 78 is a condenser.

In some embodiments, the coil panels 74, 78 includes channels or microchannels and a plurality of fins extending from the channels or microchannels. The fins provide increased surface area for heat transfer between the microchannels and the airflow. In some embodiments, the fins extend from one or both lateral sides of a microchannel such that the fins occupy the space between adjacent microchannels. Examples of such microchannels and fins are described in U.S. patent application Ser. No. 17/434,120, filed Aug. 26, 2021, which is incorporated herein in its entirety.

In some embodiments, the heat exchanger assembly 10 include two or more microchannels, including, but not limited to, 3, 4, 5, 6, 7, 8, 9, 10, 12, 14, 16, 18, 20, 30, 40, 50, 60, 70, 80, 90, 100 or more separate microchannels within a single channel within a coil panel. The number of channels and microchannels is determined based on various factors, such as system parameters, the working fluid, the size and spatial limitations of the enclosure-of-interest, the heat load of the enclosure-of-interest, the external environment, and the like. The configurations of the channels and microchannels (e.g., size, shape, depth) also varies on these and other factors. Generally, the channels and microchannels are configured to maximize heat transfer within a given area; therefore, any configuration that contributes to greater heat transfer can be used. In some embodiments, the channels and microchannels are symmetrically configured and/or are of uniform shape and size with respect to the other channels and microchannels in the heat exchanger. In other embodiments, the channels and microchannels are asymmetrically configured and/or are of variable shape and size with respect to the other channels and microchannels in the heat exchanger.

With continued reference to FIG. 4, the first coil panel 74 includes a first lower header 82 positioned at a bottom end 86 of the first coil panel 74 and a first upper header 90 positioned at a top end 94 of the first coil panel 74. Likewise, the second coil panel 78 includes a second lower header 98 positioned at a bottom end 102 of the second coil panel 78 and a second upper header 106 positioned at a top end 110 of the second coil panel 78. In the illustrated embodiment, the first coil panel 74 is positioned below the second coil panel 78, as viewed from the frame of reference of FIG. 3. In other words, with respect to a gravity vector the first coil panel 74 is positioned lower than the second coil panel 78. As such, the angled condenser panel 78 is positioned above the angled evaporator panel 74. In the illustrated embodiment, the first upper header 90 is positioned vertically between the first lower header 82 and the second lower header 98, as viewed from the frame of reference of FIG. 3. In other words, the first coil panel 74 and the second coil panel 78 do not overlap vertically. In other embodiments, the first coil panel and the second coil panel overlap vertically such that the first upper header 90 is positioned vertically between the second lower header 98 and the second upper header 106.

The upper headers 90, 106 and the lower headers 82, 98 are positioned at the terminal ends of the coil panels 74, 78 and create sealed compartments in which the working fluid can pass from one channel to another to equalize pressure among the channels in the system. For example, the header 106 encloses the terminal ends of the channels in the upper coil panel 78 to create a sealed compartment. The upper headers 90, 106 generally contain the working fluid in a substantially gaseous state, which forms condensate when exposed to cooler external air (FIG. 4). The lower headers 82, 98 generally contain the working fluid in a substantially liquid state, which evaporates when exposed to warmer air from the internal environment of an enclosure-of-interest (FIG. 4). The exact depth by which the terminal ends of the channels extend into the upper and lower headers can vary depending on factors such as the number of channels, the type of working fluid, the size of the sealed compartment, and the like.

Additionally, in some embodiments, the upper headers 90, 106 and the lower headers 82, 98 are symmetrically configured and/or are of uniform shape and size with respect to each other. In some embodiments, the upper headers 90, 106 and the lower headers 82, 98 are asymmetrically configured and/or are of variable shape and size with respect to each other. The shape of the upper headers 90, 106 and the lower headers 82, 98 can be rounded, oval, square, octagonal, and the like. In some embodiments, the upper headers 90, 106 and the lower headers 82, 98 are welded, brazed, or fitted mechanically with a sealant compound into position during assembly of the heat exchanger device such that they are generally in a fixed position. Welding can include, for example, TIG welding or laser welding, though other suitable types of welding could also be used. In some embodiments, a header includes a charge port that provides an inlet for injecting the working fluid into the coil. Generally, once the working fluid is injected into the coil and properly pressurized, the charge port is permanently sealed off.

With continued reference to FIG. 3, the first coil panel 74 is angled with respect to a vertical plane 114 by a first angle 118. Likewise, the second coil panel 78 is angled with respect to the vertical plane 122 by a second angle 126. In some embodiments, the first angle 118 is within a range of approximately 0 degree to approximately 80 degrees. In the illustrated embodiment, the first angle 118 is approximately 20 degrees. In some embodiments, the second angle 126 is within a range of approximately 0 degree to approximately 80 degrees. In the illustrated embodiment, the second angle 126 is approximately 20 degrees.

In the illustrated embodiments, both of the panels 74, 78 are angled (i.e., the first coil panel 74 is an angled evaporator panel and the second coil panel 78 is an angled condenser panel). In other embodiments, one of the coil panels is angled and the other coil panel is vertical. In the illustrated embodiments, the first angle 118 is equal to the second angle 126. In other embodiments, the first angle 118 is different than the second angle 126.

With continued reference to FIG. 4, a plurality of tubes interconnects the first coil panel 74 and the second coil panel 78. In the illustrated embodiment, a first tube 130A and a second tube 130B extend between the first upper header 90 and the second upper header 106, and a third tube 134A and a fourth tube 134B extend between the first lower header 82 and the second lower header 98. As explained in greater detail herein, a working fluid is positioned within the first coil panel 74, the second coil panel 78, the first tube 130A, the second tube 130B, the third tube 134A, and the fourth tube 134B. In other words, a single common working fluid flows through the panels 74, 78 and the tubes 130A, 130B, 134A, 134B. In some embodiments, a first plurality of tubes (e.g., tubes 130A, 130B) extend between an upper evaporator header and an upper condenser header and a second plurality of tubes (e.g., tubes 134A, 134B) extend between a lower evaporator header and a lower condenser header.

As used herein, the term "working fluid" generally refers to the fluid inside the channels/microchannels, and header, and can be any fluid or gas capable of absorbing and/or transmitting energy. The working fluid is generally in a saturated state (i.e., liquid phase and vapor phase are in simultaneous equilibrium), and it undergoes a phase change due to gain or loss of heat. As the working fluid absorbs heat generated from inside the enclosure-of-interest 46, the working fluid is vaporized in the lower coil 74 of the heat exchanger 18 and rises upward in a gaseous state to the upper coil 78 of the heat exchanger 18. Then the working fluid is exposed to cooler ambient or external air, which causes the working fluid to condense and fall back to the lower coil portion in a liquid state. This process results in the passive removal of heat from the enclosure-of-interest 42.

In some embodiments, the working fluid is an environmentally compatible refrigerant. In some embodiments, the working fluid is a dielectric, non-flammable fluid with low toxicity. In some embodiments, the working fluid is a type of hydrocarbon, such as, but not limited to, acetone, ethylene, isobutane, methanol, ethanol, tetrofluoroethane, hydrofluoroether, and/or combinations thereof. In some embodiments, the composition of the working fluid and internal pressure are selected to provide a boiling point of the working fluid in the lower coil portion at about the desired operating temperature of the electronic devices in an enclosure-of-interest (e.g., approximately 30-100° C.). Examples of working fluid include, but are not limited to, Vextral XF (2,3-dihydrodeca-fluoropentane; DuPont), Flourinert Electronic Liquid FC-72 (3 M), R134a (1,1,1,2-tetrofluoroethane; Honeywell), R1234yf (2,3,3,3-Tetrafluoroprop-1-ene; Honeywell), Novec 7100 (methoxy-nonafluorobutane; 3 M), HFC245fa (1,1,1,3,3-Pentafluoropropane; Honeywell), R410a (mixture of difluoromethane (R-32) and pentafluoroethane (R-125); Honeywell), and various water/glycol mixtures.

In conventional thermosiphons, all the working fluid travels through a single tube, and this tube is often smaller than the needed thermosiphon flow rate, which causes a restriction in the system. In some embodiments, a tube size (e.g., tube diameter) is increased to increase the flow rate through the tube. In some embodiments, the tube diameter is within a range of approximately 12 mm to approximately 22 mm. Although increasing the tube size (e.g., tube diameter) can increase the flow rate, there is a practical limit due to the size of the headers on the coils panels.

In the illustrated embodiment, there are two tubes interconnecting a pair of headers, for a total of four tubes. In the illustrated embodiment, the first tube 130A, the second tube 130B, the third tube 134A, and the fourth tube 134B extend through the dividing wall 66. For example, the first tube 130A and the second tube 130B interconnect the first upper header 90 and the second upper header 106. In other embodiments, there are at least two (i.e., 2, 3, 4, etc.) tubes interconnecting a pair of headers. For example, in some embodiments, the heat exchanger assembly further includes a fifth tube extending between the first upper header and the second upper header, and a sixth tube extending between the first lower header and the second lower header, with the working fluid also positioned within the fifth and sixth tubes.

Advantageously, the flow restriction of conventional designs is resolved by the disclosure provided herein by increasing the number of tubes fluidly interconnected between the two coil panels 74, 78. The more than one tube reduces the flow restriction between the evaporator coil 74 and the condenser coil 78. The additional flow capacity is beneficial in part because the working fluid flow is driven by gravity. In other words, with only gravity as the mechanism to cause the working fluid to flow, decreasing the flow restriction helps transfer heat from the evaporator to the condenser. In the illustrated embodiment, the flow of the working fluid is balanced between the first tube 130A and the second tube 130B and is also balanced between the third tube 134A and the fourth tube 134B.

Providing more than one tube interconnecting a pair of headers between a condenser and an evaporator, as illustrated herein, has the following distinct advantages. First, the increase in cross-sectional area allows for increased flow of the working fluid. In some embodiments, the flowrate of the working fluid between the first coil panel 74 and the second coil panel 78 is within a range of approximately 0.3 $in^3/s$ (cubic inches per second) to approximately 1.0 $in^3/s$. Second, the thermal performance of the overall system is increased; even when all other factors remain the same (e.g., coil size, airflow, and fan tube diameter). In some embodiments, the thermal performance of the overall heat exchanger assembly 10 is increased at least approximately 30%. In some embodiments, the thermal performance of the heat exchanger assembly 10 is increased within a range of approximately 30% to approximately 50%. As such, the heat exchanger assembly 10 disclosed herein includes more than one tube fluidly coupling a pair of headers between a condenser and an evaporator, increased flowrate of the working fluid, and an increased tube diameter.

In operation of the heat exchanger assembly 10, the second fan 54 draws external air into the sealed second chamber 70B and upward towards the upper condenser coil 78 comprising working fluid in a substantially gaseous state sufficient to cause condensation of the gaseous working fluid. Simultaneously, the first fan 50 draws internal air from the enclosure-of-interest 46 into the sealed first chamber 70A and downward towards the lower evaporator coil 78 comprising working fluid in a substantially liquid state sufficient to cause evaporation of the liquid working fluid. In some embodiments, at least a portion of the sealed chambers 70A, 70B are coupled to the dividing wall 66 to prevent contamination of the internal airflow 58 and the external airflow 62.

Embodiments of the present disclosure also include methods of manufacturing the heat exchanger assembly 10 of the present disclosure. In one embodiment, the heat exchanger assembly 10 can be assemble using a brazing or welding process. Brazing can be performed by hand for smaller volumes or, for example, in a controlled atmospheric brazing oven for larger volumes. TIG welding can be performed by hand for smaller volumes, and laser welding is generally more suitable for larger volumes.

In some embodiments, the various internal and/or external surfaces of the components of the heat exchanger devices of the present disclosure can be coated. Coatings can extend the working life of these components and/or improve performance by reducing corrosion. Corrosion can take various forms, including but not limited to, galvanic, stress cracking, general, localized and caustic agent corrosion. Corrosion resistant coatings for various metals vary depending on the kind metal involved and the kind of corrosion prevention required. For example, to prevent galvanic corrosion in iron and steel alloys, coatings made from zinc and aluminum are useful. Larger components are often treated with zinc and aluminum corrosion resistant coatings because they provide reliable long-term corrosion prevention. Steel and iron fasteners, threaded fasteners, and bolts can be coated with a thin layer of cadmium, which helps block hydrogen absorption which can lead to stress cracking. In addition to cadmium, zinc, and aluminum coatings, nickel-chromium and cobalt-chromium can be used as corrosive coatings because of their low level of porosity. These coatings are extremely moisture resistant and therefore help inhibit the development of rust and the eventual deterioration of metal. Oxide ceramics and ceramic metal mixes are other examples of coatings that are strongly wear resistant, in addition to being corrosion resistant.

In some embodiments, the heat exchanger 18 is fitted together by hand or with simple tools. In some embodiments, the heat exchanger 18, once assembled, can be inserted into a passive cooling system (e.g., heat exchanger assembly 10) and riveted or screwed into places. Gaskets and sealants can also be used to bond the assembled heat exchanger 18 into the housing 14.

Embodiments of the present disclosure include passive cooling systems (e.g., the heat exchanger assembly 10) comprising the heat exchanger 18 described above. In accordance with these embodiments, the systems can include any of the passive heat exchanger 18 described herein, at least one fan 50, 54, and a housing 14 that contains the heat exchanger 18 and the fan 50, 54, as shown in FIGS. 1 and 2. Embodiments of the heat exchanger assembly 10 of the present disclosure can be sized and shaped in various ways that are suitable for a given purpose and location. For example, in some embodiments, a width of the housing 14 is within a range of approximately 100 mm to approximately 1000 mm; a height of the housing 14 is within a range of approximately 500 mm to approximately 2000 mm; and a depth of the housing 14 is within a range of approximately 100 mm to approximately 1000 mm. In one embodiment, the heat exchanger assembly 10 is approximately 18"×12"×14" in size and provides approximately 50-500 CFM for an approximately 4,000 $ft^2$ enclosure of interest, which results in approximately 4,500 CFM/hr of airflow.

It will be readily apparent to those skilled in the art that other suitable modifications. It is understood that the foregoing detailed description and accompanying examples are merely illustrative and are not to be taken as limitations upon the scope of the disclosure, which is defined solely by the appended claims and their equivalents. Various changes and modifications to the disclosed embodiments will be apparent to those skilled in the art. Such changes and modifications, including without limitation those relating to the chemical structures, substituents, derivatives, intermediates, syntheses, compositions, formulations, or methods of use of the disclosure, may be made without departing from the spirit and scope thereof.

What is claimed is:

1. A heat exchanger comprising:

a first coil panel having a first lower header and a first upper header;

a second coil panel having a second lower header and a second upper header;

a dividing wall positioned between the first coil panel and the second coil panel;

a first tube and a second tube extending between the first upper header and the second upper header;

a third tube and a fourth tube extending between the first lower header and the second lower header; and a working fluid positioned within the first coil panel, the second coil panel, the first tube, the second tube, the third tube, and the fourth tube; and wherein the first tube, the second tube, the third tube, and the fourth tube extend through the dividing wall.

2. The heat exchanger of claim 1, wherein the first coil panel is positioned below the second coil panel.

3. The heat exchanger of claim 1, wherein the first upper header is positioned between the first lower header and the second lower header.

4. The heat exchanger of claim 1, wherein the first coil panel is angled with respect to a vertical plane.

5. The heat exchanger of claim 4, wherein the first coil panel forms an angle with respect to the vertical plane within a range of 0 degrees to 80 degrees.

6. The heat exchanger of claim 5, wherein the angle is 20 degrees.

7. The heat exchanger of claim 4, wherein the second coil panel is angled with respect to the vertical plane.

8. The heat exchanger of claim 7, wherein the second coil panel forms an angle with respect to the vertical plane within a range of 0 degrees to 80 degrees.

9. The heat exchanger of claim 8, wherein the angle is 20 degrees.

10. The heat exchanger of claim 1, wherein a flowrate of the working fluid between the first coil panel and the second coil panel is within a range of 0.3 $in^3/s$ to 1.0 $in^3/s$.

11. The heat exchanger of claim 1, wherein the first tube includes a diameter within a range of 12 mm to 22 mm.

12. The heat exchanger of claim 1, wherein the first coil panel includes a plurality of channels, and wherein each of the plurality of channels includes a plurality of microchannels, and wherein each of the plurality of microchannels comprise a plurality of fins extending from the plurality of microchannels that increase the surface area for heat transfer.

13. The heat exchanger of claim 1, wherein the first lower header and first upper header are sealed to create sealed compartments, wherein the working fluid can move freely within both the sealed compartments, wherein the first upper header comprises working fluid in a substantially gaseous state, and wherein the first lower header comprises working fluid in a substantially liquid state.

14. The heat exchanger of claim 1 further comprising a housing including an external air inlet, an external air outlet, an internal air inlet, and an internal air outlet;

a first fan positioned at the internal air inlet configured to create an internal airflow through the housing from the internal air inlet to the internal air outlet;

a second fan positioned at the external air inlet configured to create an external airflow through the housing from the external air inlet to the external air outlet; wherein the external airflow is isolated from the internal airflow.

15. The heat exchanger of claim 14, wherein the external airflow is isolated from the internal airflow by the dividing wall positioned within the housing.

* * * * *